US007128666B2

(12) United States Patent
Veilleux et al.

(10) Patent No.: US 7,128,666 B2
(45) Date of Patent: Oct. 31, 2006

(54) DIMPLES COMPRISED OF TWO OR MORE INTERSECTING SURFACES

(75) Inventors: Thomas A. Veilleux, Charlton, MA (US); Vincent J. Simonds, Brimfield, MA (US); Kevin Shannon, Springfield, MA (US)

(73) Assignee: Callaway Golf Company, Carlsbad, CA (US)

( * ) Notice: Subject to any disclaimer, the term of this patent is extended or adjusted under 35 U.S.C. 154(b) by 34 days.

(21) Appl. No.: 10/920,591

(22) Filed: Aug. 18, 2004

(65) Prior Publication Data

US 2005/0043119 A1 Feb. 24, 2005

Related U.S. Application Data

(60) Provisional application No. 60/496,106, filed on Aug. 18, 2003.

(51) Int. Cl.
*A63B 37/14* (2006.01)

(52) U.S. Cl. ..... 473/384

(58) Field of Classification Search ..... 473/378, 473/383–385

See application file for complete search history.

(56) References Cited

U.S. PATENT DOCUMENTS

| | | | | |
|---|---|---|---|---|
| 1,418,220 | A | | 5/1922 | White |
| D107,066 | S | | 11/1937 | Cavignac |
| D176,470 | S | | 12/1955 | Martin et al. |
| 2,861,810 | A | | 11/1958 | Veatch |
| D228,394 | S | | 9/1973 | Martin et al. |
| 4,090,716 | A | | 5/1978 | Martin et al. |
| 4,830,378 | A | | 5/1989 | Aoyama |
| 4,836,552 | A | | 6/1989 | Puckett et al. |
| 4,840,381 | A | | 6/1989 | Ihara et al. |
| 4,869,512 | A | | 9/1989 | Nomura et al. |
| 5,024,444 | A | | 6/1991 | Yamagishi et al. |
| 5,080,367 | A | | 1/1992 | Lynch et al. |
| 5,174,578 | A | * | 12/1992 | Oka et al. ..... 473/384 |
| 5,338,039 | A | * | 8/1994 | Oka et al. ..... 473/384 |
| 5,470,076 | A | | 11/1995 | Cadorniga |
| 5,536,013 | A | | 7/1996 | Pocklington |
| 5,564,708 | A | | 10/1996 | Hwang |
| 5,722,903 | A | | 3/1998 | Moriyama et al. |
| 5,779,563 | A | | 7/1998 | Yamagishi et al. |
| 5,842,937 | A | | 12/1998 | Dalton et al. |
| 5,984,807 | A | | 11/1999 | Wai et al. |
| 6,039,660 | A | | 3/2000 | Kasashima et al. |
| 6,053,820 | A | | 4/2000 | Kasashima et al. |
| 6,059,671 | A | | 5/2000 | Asakura |
| D433,472 | S | | 11/2000 | Ogg et al. |
| 6,293,877 | B1 | | 9/2001 | Boehm |
| D449,358 | S | | 10/2001 | Ogg |
| 6,383,092 | B1 | | 5/2002 | Ogg |
| 6,454,668 | B1 | | 9/2002 | Kasashima et al. |
| 6,471,605 | B1 | | 10/2002 | Ogg |

(Continued)

*Primary Examiner*—Raeann Gorden
(74) *Attorney, Agent, or Firm*—Michael A. Catania; Elaine H. Lo

(57) ABSTRACT

A golf ball with a dimple pattern designed to maximize flight characteristics employs dimples which are created by joining two or more intersecting surfaces. The invention provides for single radius or dual radius dimples, preferably including smaller radius cylinders tangentially arranged along the side of the larger cylinders. The intersection of the cylinders forms tri-cylinders, tri-semicylinders, bi-cylinders, quad-semicylinders, penta-semicylinders, or more generally n-cylinders depending upon the number of intersecting cylinders. The golf ball includes a plurality of single or dual radius dimples created by intersecting n-cylinders to create maximum turbulence on the ball during flight.

6 Claims, 9 Drawing Sheets

U.S. PATENT DOCUMENTS

| | | | |
|---|---|---|---|
| 6,547,678 | B1 | 4/2003 | Barfield |
| 6,569,038 | B1 | 5/2003 | Sullivan |
| 6,599,204 | B1 | 7/2003 | Kasashima et al. |
| 6,620,060 | B1 | 9/2003 | Ogg et al. |
| 6,626,772 | B1 | 9/2003 | Kennedy, III |
| 2001/0002373 | A1 | 5/2001 | Yamagishi et al. |
| 2001/0005700 | A1 | 6/2001 | Kasashima et al. |
| 2003/0083153 | A1 | 5/2003 | Sullivan et al. |
| 2003/0158002 | A1 | 8/2003 | Morgan et al. |

* cited by examiner

FIG.1 (PRIOR ART)
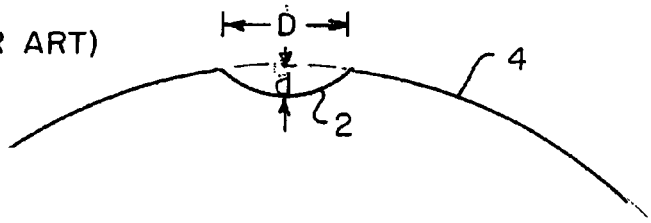
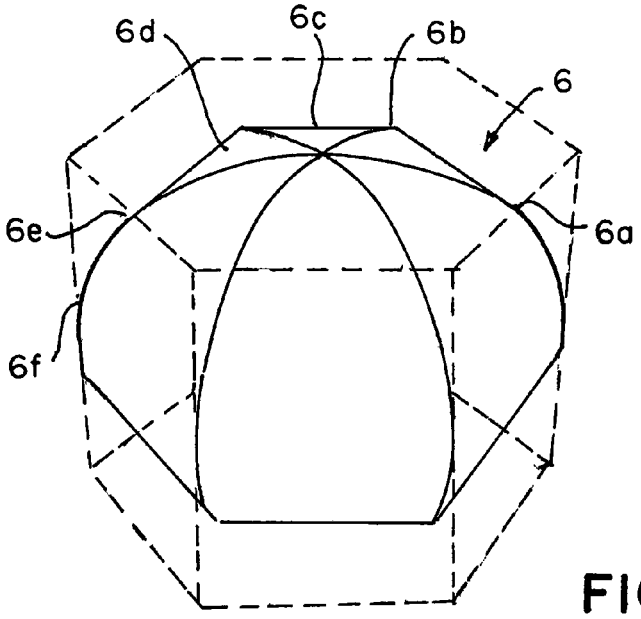
FIG. 2
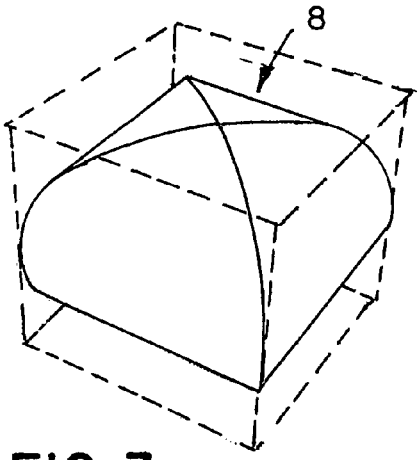
FIG. 3
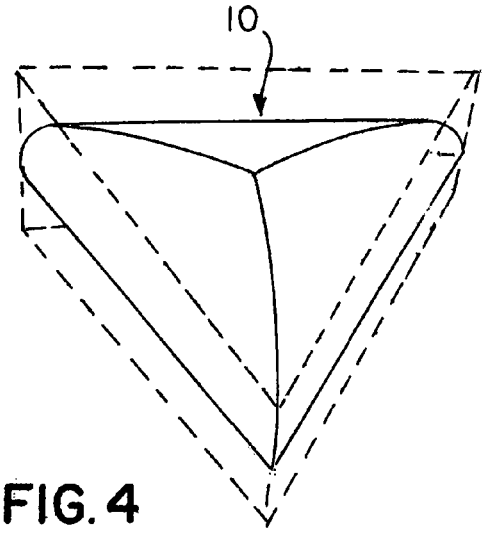
FIG. 4

DIMPLES COMPRISED OF TWO OR MORE INTERSECTING SURFACES

This application claims the benefit of U.S. Provisional Application No. 60/496,106 filed on Aug. 18, 2003.

BACKGROUND OF THE INVENTION

The present invention relates to a new golf ball dimple configuration comprised of two or more intersecting surfaces. Preferably, the intersecting surfaces are cylindrical.

Dimples are provided in the surface of a golf ball in order to control and improve the flight of the ball. The dimples serve to reduce the pressure differential between the front and rear of the ball as it rotates and travels through the air. One basic criteria for the use of dimples is maximize the surface coverage of dimples on the ball without diminishing the aerodynamic symmetry of the ball.

Golf balls are produced having various dimple patterns, dimple sizes, and dimple configurations so as to have a substantially constant geometric surface while improving the flight characteristics of the ball.

Brief Description of the Prior Art

It is known in the prior art to provide a golf ball with a plurality of circular and non-circular dimples to improve ball flight. The Sullivan et al U.S. Pat. No. 6,176,793, for example, discloses a golf ball with regular circular dimples and contoured dimples. The contoured dimples have different shapes including oval, triangular, stair stepped, and sinusoidal. The Oka Pat. No. 5,338,039 discloses a golf ball having polygonal dimples with a double slope in cross-section.

While prior dimple designs operate satisfactorily, they have inherent limitations with regard to maximizing dimple coverage on a golf ball surface while providing the necessary cutting action through the atmosphere that enables a golf ball to travel farther and straighter.

SUMMARY OF THE INVENTION

It is a primary object of the invention to provide a golf ball dimple configured to generate optimal turbulence on a golf ball for improved flight characteristics and a method for creating the dimple geometry resulting in the desired configurations.

The dimple has a bottom surface including multiple portions defined by at least two intersecting surfaces. Each portion of the dimple bottom corresponds with one surface. The surfaces are preferably cylindrical, and three such surfaces are provided. The first bottom portion of the dimple is defined by a first cylinder having a first radius, and second and third bottom portions are defined by second and third cylinders having equal radii which are less than the radius of the first cylinder.

In a more specific embodiment, three tri-cylinders intersect to define a geometric configuration used to form the dimple bottom surface. Each tri-cylinder is defined by the intersection of one large radius and two small radius cylinders as set forth above.

The dimple configuration may also be defined by a tetrahedron formed by the intersection of at least three surfaces. The intersecting surfaces may be planar or curved, such as portions of a sphere or cylinder. Preferably, the top of the tetrahedron is truncated by a planar or curved surface to define the geometric configuration of the dimple. The resulting dimples may have a triangular, quadrangular, pentagonal or hexagonal shape where the dimple volumes meet the surface of the golf ball.

Such dimples are provided in a golf ball surface. All of the dimples in the ball surface may have the same configuration, or a variety of dimples of different configurations may be provided in the ball surface to maximize dimple coverage thereon. The dimples can also be arranged in the surface in a geometric pattern.

BRIEF DESCRIPTION OF THE DRAWINGS

Other objects and advantages of the invention will become apparent from a study of the following specification when viewed in the light of the accompanying drawings, in which:

FIG. 1 is sectional view of a golf ball having a conventional circular dimple as known in the art;

FIG. 2 is a perspective view of a regular dual radius tri-cylinder and its circumscribed prism according to the invention;

FIG. 3 is a perspective view of a regular bi-cylinder and its circumscribed prism according to the invention;

FIG. 4 is a perspective view of a regular tri-semicylinder and its circumscribed prism according to the invention;

DESCRIPTION OF THE PREFERRED EMBODIMENT

Figure 5:
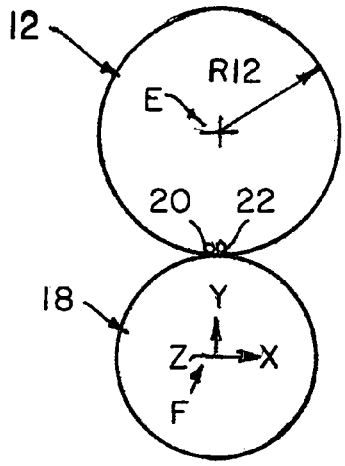
FIG. 5 is a plan view of a golf ball and three intersecting cylinders showing the correlation between the intersection of the surfaces of the cylinders with the golf ball surface.

In FIG. 1 there is shown the cross-sectional configuration of a conventional circular dimple 2 in the surface of a golf ball 4. The dimple has a diameter D and a depth d. A circular dimple can be thought of as being created by the intersection of a spherical surface with the surface of a golf ball, with the radius of the dimple being defined by the radius of the sphere.

The present invention relates to non-circular dimple geometries formed by intersecting surfaces, such as for example, cylindrical and planar surfaces. Intersecting cylinders form tri-cylinders, tri-semicylinders, bi-cylinders, quad-semicylinders or more generally n-cylinders. Dimple volumes are formed by the intersecting n cylinders, with their long axes coplanar and equal angles between those long axes.

As will be developed in detail below, the intersecting cylinders may have a pair of smaller cylinders tangent to the larger cylinder on each side to form edge radii of the dimple. This is similar to a dual radius dimple profile. A dual radius dimple is formed with a larger spherical radius (as the bottom of the dimple) tangent to a torus of smaller radius (forming an edge radius). The dual radius n-cylinder dimple bottom is formed by n cylinders and the edge radius is formed by a pair of smaller cylinders tangent to each of the larger cylinders. These are called dual radius tri-cylinders, tri-semicylinders, bi-cylinders, and quad-semicylinders. The dimples volumes are formed by the intersecting n cylinders (each with a pair of smaller tangent cylinders), with their long axes coplanar and equal angles between those long axes. If the radii of the cylinders used to form these shapes are the same, the shape is regular. Two dimensional cross-sections of these volumes (cut parallel to the plane of the long axes) are regular 2n-gons, e.g. a regular polygon of 2×n sides.

Examples of the geometries used to create dimples in accordance with the invention are shown in FIGS. 2, 3, and 4. More particularly, FIG. 2 shows the geometry defined by the intersection of three cylinders of the same diameter and is referred to as a symmetric tri-cylinder 6. The hexagonal prism circumscribed by the tri-cylinder is shown in phantom. Tri-cylinders are formed from three cylinders oriented 120° apart with a common axis of rotation central to the dimple volume. The configuration of the two-dimensional cross-section is a hexagon. When this volume is removed from a sphere to form a dimple, the intersecting surface is not planar, but rather resembles a hexagon having curved edges.

FIG. 3 shows the geometry defined by the intersection of two cylinders of the same diameter and is a symmetric bi-cylinder 8 with the circumscribed square prism shown in phantom. Bi-cylinders are formed from two cylinders oriented 90° apart with a common axis of rotation central to the dimple volume. The configuration of the two-dimensional cross-sections are not squares. When this volume is removed from a sphere to form a dimple, the intersecting surface is not planar, but rather resembles a square having curved edges.

FIG. 4 shows the geometry defined by the intersection of three eccentric cylinders, i.e. a tri-semicylinder 10 with a triangular circumscribed prism shown in phantom. Tri-semicylinders are formed from three cylinders oriented 120° apart with a common axis of rotation that is eccentric from the geometric center of the dimple volume. The configuration of the two-dimensional cross-sections is a triangle. When this volume is removed from a sphere to form a dimple, the intersecting surface is not planar, but rather resembles a triangle having curved edges.

Quad-cylinders (not shown) are formed from four cylinders oriented 45° apart with a common axis of rotation central to the dimple volume. The configuration of the two-dimensional cross-sections is an octagon. When this volume is removed from a sphere to form a dimple, the intersecting surface is not planar, but rather resembles an octagon having curved edges.

Figure 6:
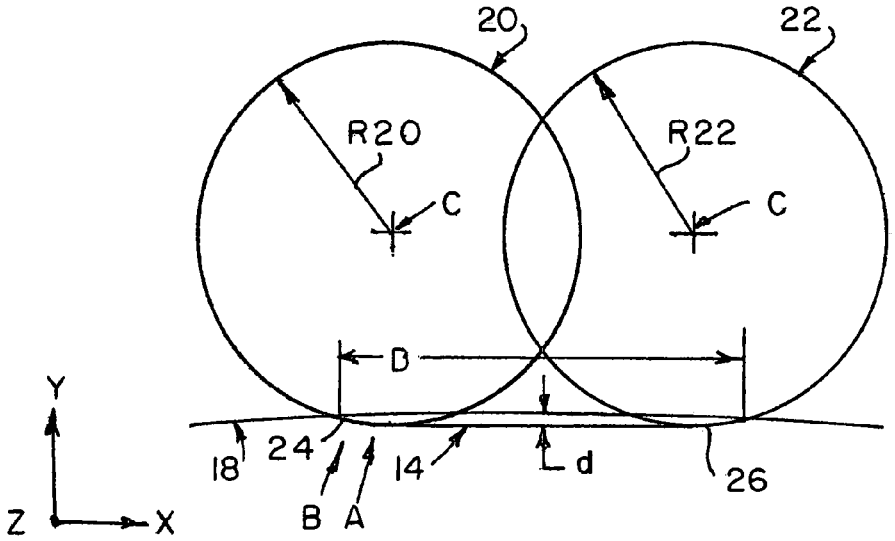
FIG. 6 is a detailed view of the golf ball of FIG. 5 showing two smaller radius cylinders intersecting the golf ball surface and which are tangent to a large cylinder.
Figure 7:
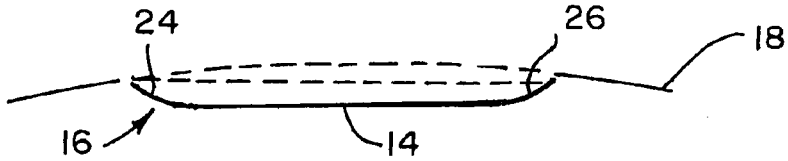
FIG. 7 is a cross-sectional view of the dimple formed using the three intersecting cylinders of FIGS. 5 and 6.

In FIGS. 5–7, there are shown dual radius cylinders used to form a further geometry for a further dimple configuration. A first cylinder 12 (FIG. 5) has a first radius R12 which is used to define the bottom portion 14 of a dimple 16 in the surface of a golf ball 18 shown in FIG. 7. That is, the bottom portion 14 of the dimple 16 has a radius R12. Second 20 and third 22 cylinders each have radii R20 and R22 which are significantly less than the radius R12 of the first cylinder. In the preferred example shown, the radii R20 and R22 are equal. However, they may be different so long as they both are less than the radius R12. The second and third cylinders are arranged at an outer edge of the first cylinder as shown in FIG. 5, with the axes of all of the cylinders being parallel. The surfaces of second 20 and third 22 cylinders intersect the golf ball surface and thus define dimple bottom portions 24 and 26, respectively. The bottom portion 24 has a radius R20 from the second cylinder 20 and the bottom portion 26 has a radius R22 from the third cylinder 22.

As shown in FIG. 6, it is preferred that the second and third cylinders overlap so that all three cylinders intersect and are tangent at the intersection. The intersection of the surfaces of the cylinders with the golf ball surface define the geometric configuration of the dimple bottom surface. The degree of overlap of the second and third cylinders will define the width of the dimple.

Stated another way, the golf ball 18 has X, Y, and Z axes and is centered at (0,0,0). The first cylinder 12 that forms the bottom of the dimple has its radius parallel with the Z-axis of the ball and is centered at (0, YE, 0). The first cylinder is sliced parallel with the YZ plane at X=XA, with the central portion of the cylinder retained. The cylinder is then sliced parallel with the YZ plane at X=−XA and the central portion is retained. Next, the edge cylinders, i.e. the second 20 and third 22 cylinders are created. These cylinders have their radii centered at (XC, YC) and (−XC, YC), respectively. The surface of the three solids defined by the joinder of the three cylinders defines the geometry of the dimple. This geometry can be used to create a dimple volume removal tool which is used to create a ball geometry for forming the dimples during molding of the cover layer of the golf ball. Where the radii of the second and third cylinders are equal, the dimple defined by the intersecting cylindrical surfaces is referred to as a dual radius cylinder dimple. The first cylinder 12 has a first radius and the second and third cylinders 20, 22 have a second radius.

Figure 8:
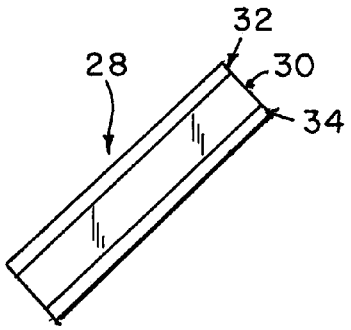
FIGS. 8, 9, and 10 are bottom views, respectively, of three dual radius cylinders used to form a dimple geometry according to another embodiment of the invention.

FIGS. 8 is a bottom view of a dual radius cylinder 28 including a large diameter cylinder portion 30 and two small diameter cylinder portions 32, 34, small cylinder portions having equal radii. As discussed above with reference to FIGS. 5–7, the small diameter cylinder portions define the edge of a dimple the large diameter cylinder portion defines the bottom of a dimple. Thus, the large diameter cylinder portion may be referred to as the bottom cylinder and the small diameter cylinder portions may be referred to as the edge cylinders.

Figure 9:
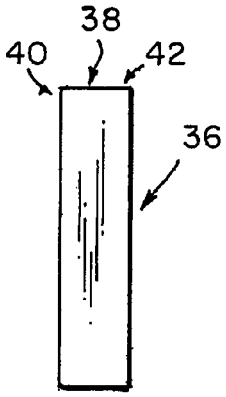
Figure 10:
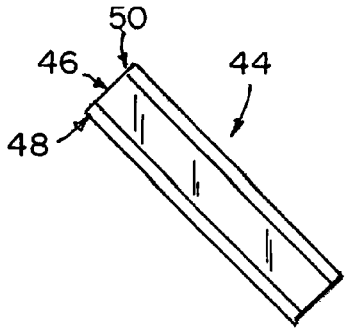

FIG. 9 is a-bottom view of a dual radius cylinder 36 including bottom cylinder 38 and edge cylinders 40, 42, and FIG. 10 is a bottom view of a dual radius cylinder 44 including bottom cylinder 46 and edge cylinders 48, 50. The dual radius cylinders 36 and 44 are similar to the dual radius cylinder 28.

Figure 11:
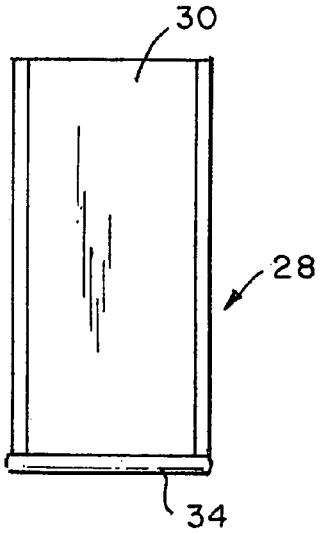
FIGS. 11, 12, and 13 are side views of the dual radius cylinders of FIGS. 8, 9, and 10, respectively.
Figure 12:
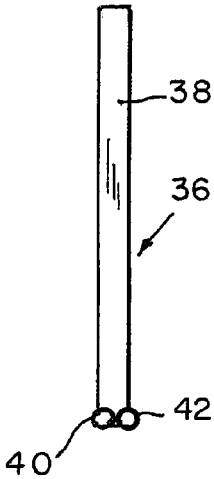
Figure 13:
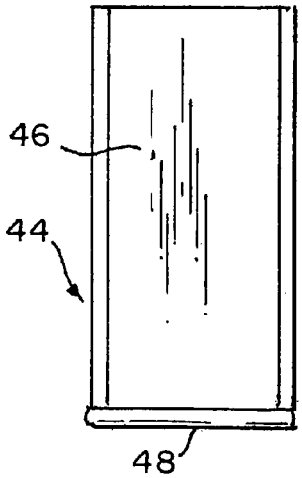

FIGS. 11–13 are side views of the dual radius cylinders 28, 36, and 44 of FIGS. 8–10, respectively.

Figure 14:
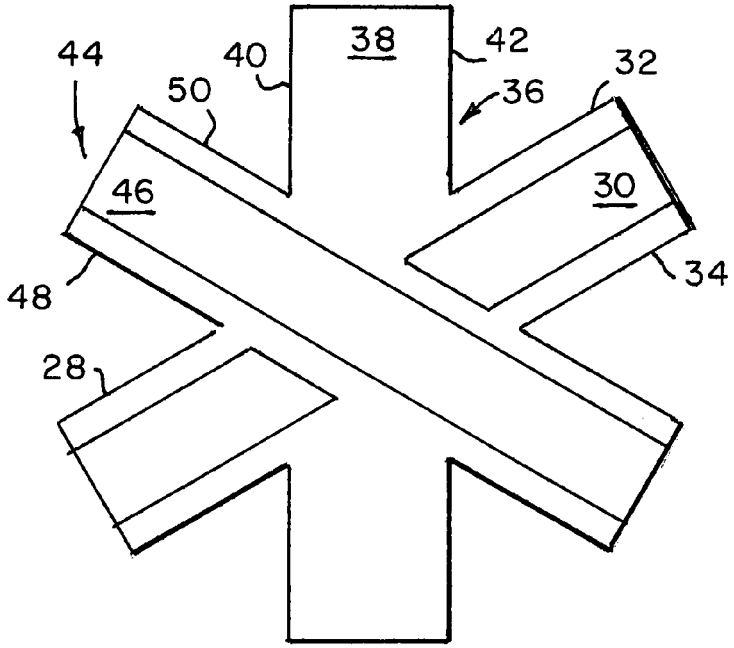
FIG. 14 is a bottom view of the dual radius cylinders of FIGS. 8, 9 and 10 showing their orientation prior to intersection.
Figure 15:
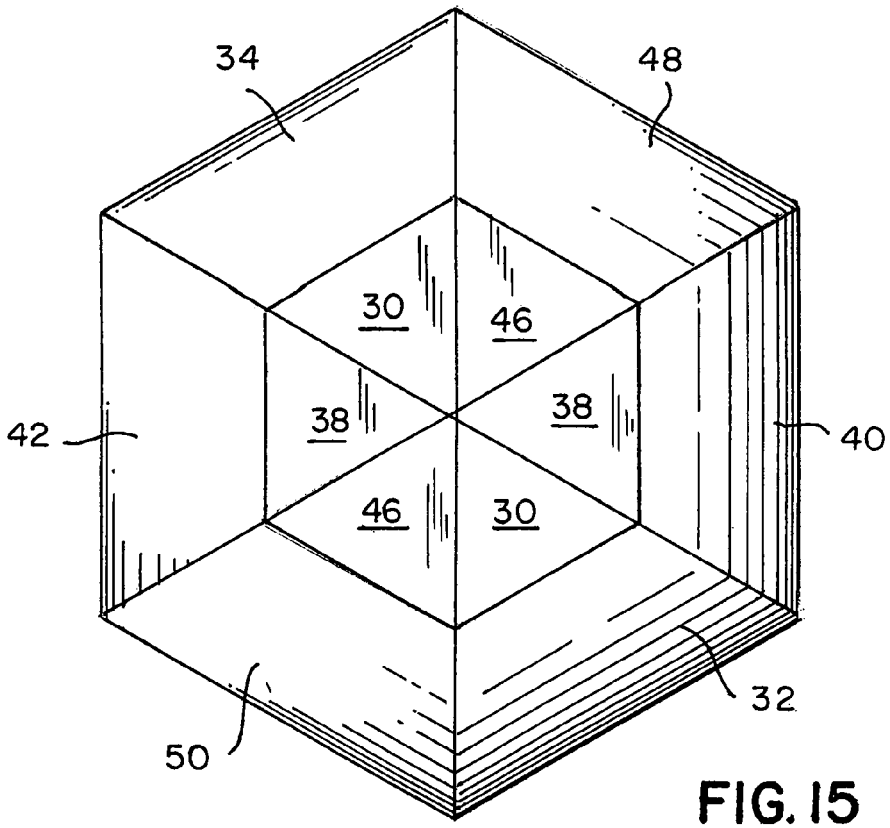
FIG. 15 is a bottom view of the geometric configuration defined by intersecting portions of the dual radius cylinders of FIG. 14.
Figure 16:
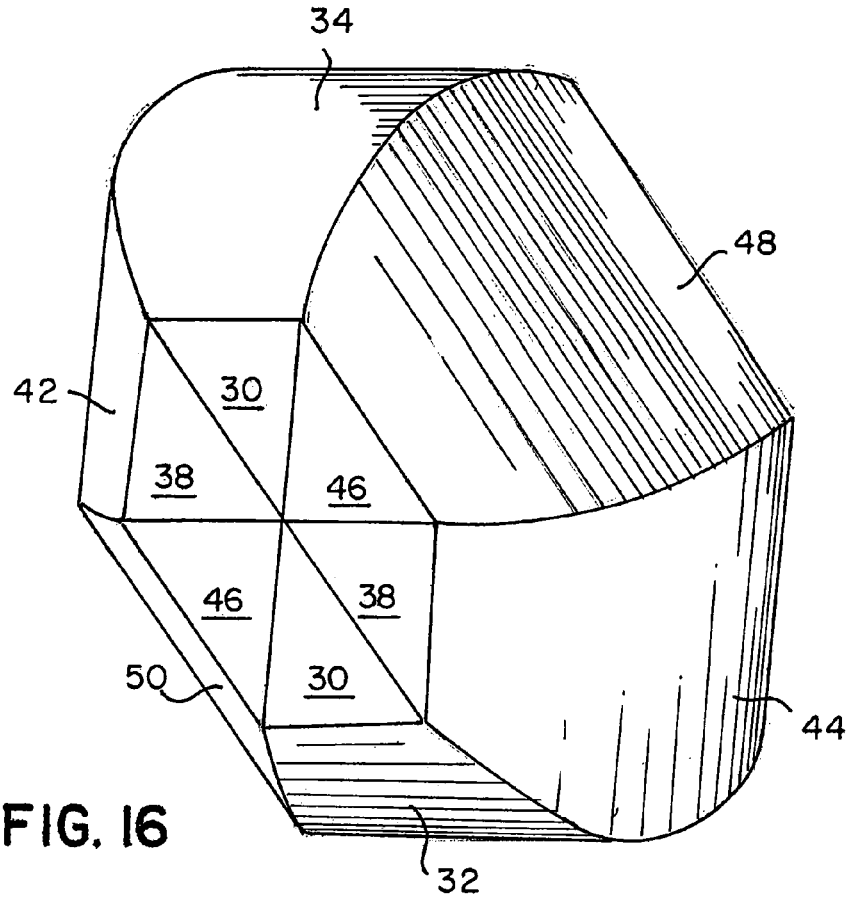
FIG. 16 is a detailed perspective view of the volume of a dimple formed using the geometric configuration shown in FIG. 15.

FIG. 14 shows the orientation of the dual radius cylinders 28, 36, and 44 prior to intersection and FIG. 15 is a detailed bottom view of the geometry defined by the intersection of the surfaces of the dual radius cylinders. In FIG. 15, all volumes of the dual radius cylinders which do not intersect have been removed to define the geometry as shown. A perspective view of the intersection geometry of FIG. 15 is shown in FIG. 16. It represents the volume of a dimple formed using the geometry. The portions 30, 38 and 46 are formed by the bottom cylindrical surface of the dual radius cylinders and define the bottom surface of the dimple and the portions 32, 34, 40, 42, 48, and 50 are formed by the edge cylindrical surfaces of the dual radius cylinders and define the edge surfaces of the dimple.

Figure 17:
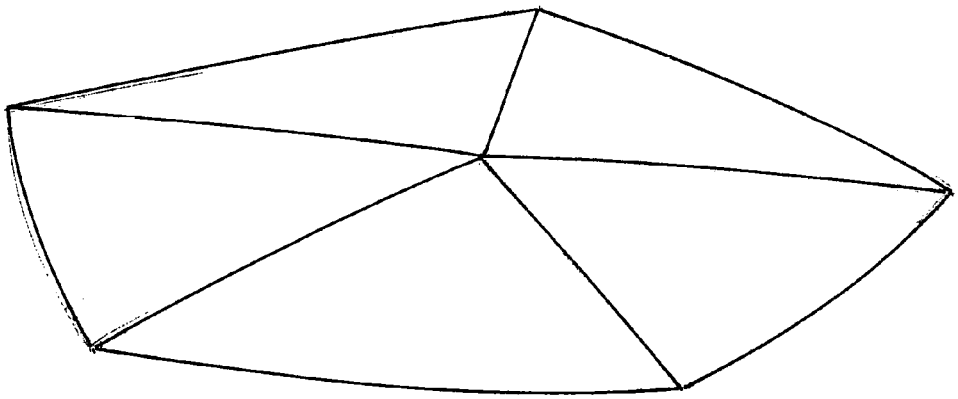
FIG. 17 is a detailed perspective view of the dimple volume formed using penta-semi-cylindrical geometry.

FIG. 17 is a perspective view of a dual radius penta-semicylinder dimple.

Figure 18A:
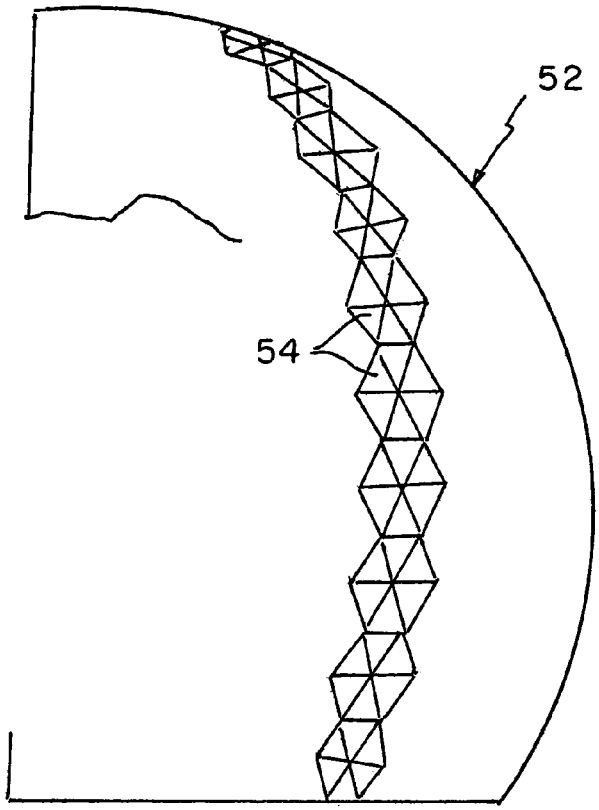
FIG. 18A is a partial plan view of a golf ball including dimples configured with a geometry based on the dual radius cylinder of FIG. 15.
Figure 18B:
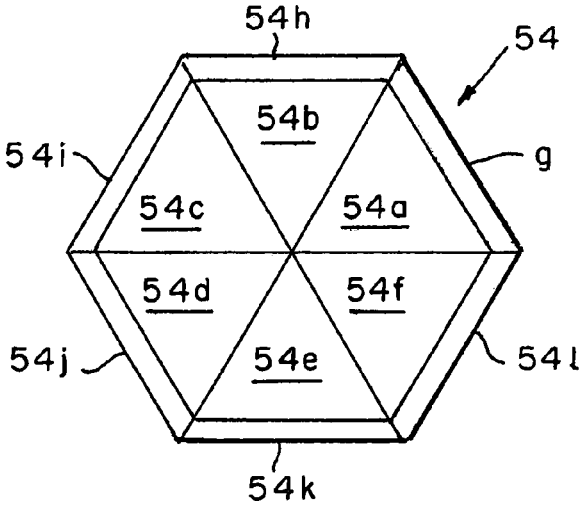
FIG. 18B is a detailed plan view of a dimple from the golf ball of FIG. 18A.

FIG. 18A shows a golf ball surface 52 having dimples 54 defined by a symmetric tri-cylinder as shown in FIG. 15 formed of dual radius cylinders as shown in FIG. 14. The upper portion of the tri-cylinder has six surfaces, two each of surfaces 30, 38, and 46. Each dimple 54 in the ball of FIG. 18A also has six surfaces 54*a*–*f* corresponding to the upper surfaces of the tri-cylinder, respectively, as shown in FIG. 18B. The mid-portion of the tri-cylinder has another six surfaces 32, 34, 40, 42, 48, and 50 which form the surfaces 54*g*–*l* in the dimple 54 in FIG. 18B. The dimples can be sized and arranged on the ball surface in a desired pattern to maximize dimple coverage on the ball surface. The size and depth of the dimples is defined by the radii of the cylinders being used to create the geometries.

A common design practice of placing dimples onto a golf ball is to begin at either the equator and work toward the pole, begin at the pole and work toward the equator, or begin at both the pole and equator and work toward the other simultaneously. It is also common that the preferred dimple sizes may not maximize surface area coverage. In this case, a variation to the n-cylinder (bi, tri, quad, penta etc.) may be employed which in effect stretches the dimple in at least one direction, similar to the way in which a circular dimple would be stretched into an ellipse. Such stretching could also result in a non-symmetric dimple. This is done to maximize surface area coverage and to create a cosmetically attractive layout.

The dimple volumes can be combined to form dimple patterns with increased dimple coverage on the surface of a golf ball. By adjusting the cylindrical radius to be somewhat similar in value to the spherical radius that forms traditional spherical dimples, these new dimple shapes have edge angles, volumes, depths, and chordal diameters similar to traditional spherical dimples. Individual dimple volumes can be tuned to match volume ratios that work for traditional spherical dimple patterns. The pair of smaller tangential cylinders allows the dimple volume and dimple edge angle to be adjusted independently.

Figure 19:
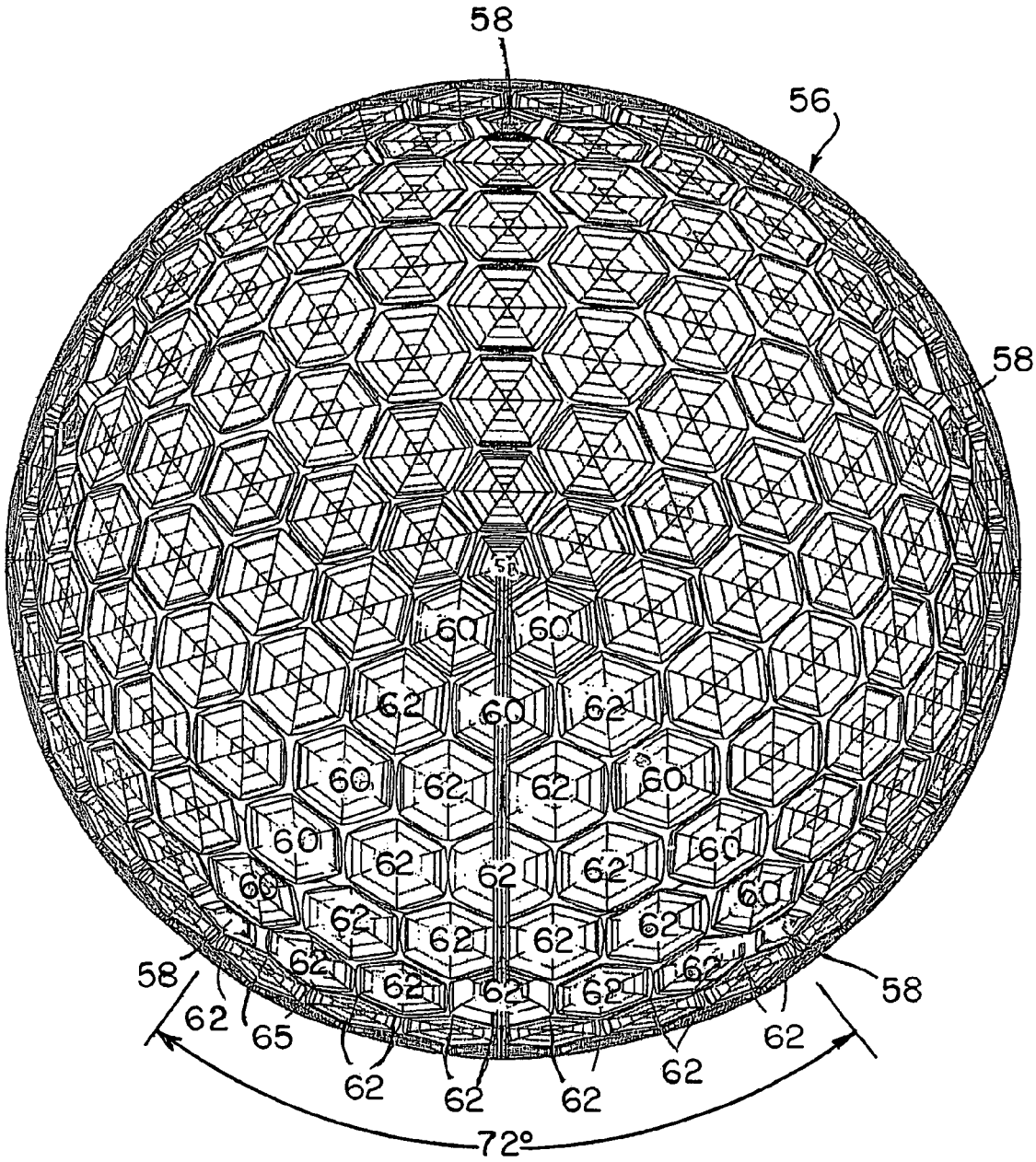
FIG. 19 is a plan view of a golf ball containing dual radii penta-semi-cylindrical dimples, symmetric dual radii tri-cylindrical dimples, and non-symmetric dual radii tri-cylindrical dimples formed in accordance with the invention.

A golf ball 56 including dimples formed in accordance with a preferred embodiment of the invention is shown in FIG. 19. The golf ball includes 12 dual radius penta-semicylinder dimples 58, 50 symmetric dual radius tri-cylinder dimples 60, and 260 non-symmetric dual radius tri-cylinder dimples 62. The pattern is repeated five times across the surface of the golf ball (i.e. five-fold symmetry) and provides 90.3% dimple surface coverage.

In lieu of intersecting cylinders, intersecting surfaces may also be used to define the geometry used to create dimple configurations in accordance with the invention. In FIGS. 20–23, three planar surfaces intersect to form a tetrahedral volume. The top of the tetrahedron can be used to form the dimple geometry.

Figure 20:
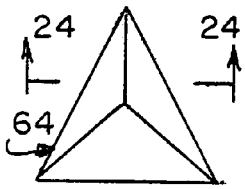
FIG. 20 is a top plan view of a tetrahedral volume formed by intersecting planar surfaces used to form a dimple geometry according to the invention.
Figure 24:
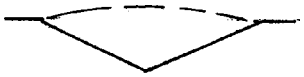
FIGS. 24–27 are sectional views taken along lines 24—24, 25—25, 26—26 and 27—27 of FIGS. 20–23, respectively, showing the resulting cross-sectional dimple configurations thereof.

The volume of FIG. 20 is a full tetrahedron 64. The cross-section of the tetrahedron taken along line 24—24 produces the dimple cross-sectional configuration shown in FIG. 24.

Figure 21:
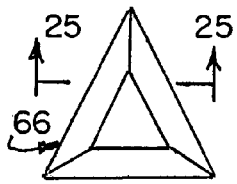
FIGS. 21–23 are top plan views of the tetrahedral volume of FIG. 20 where the top portion of the volume has been truncated in accordance with the invention.
Figure 25:
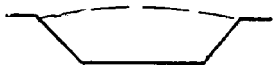

The volume of FIG. 21 is a truncated tetrahedron 66. The top of the tetrahedron is truncated by a fourth planar surface which is parallel to the plane of the bottom of the tetrahedron. The cross-section of the tetrahedron 66 taken along line 25—25 produces the dimple cross-sectional configuration shown in FIG. 25.

Figure 22:
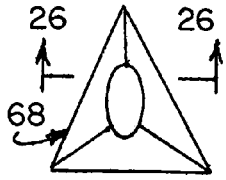
Figure 26:
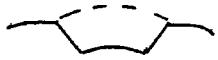

The volume of FIG. 22 is a truncated tetrahedron 68. The top of the tetrahedron is truncated by a fourth convex surface. The cross-section of the tetrahedron 68 taken along line 26—26 produces the dimple cross-sectional configuration shown in FIG. 26.

Figure 23:
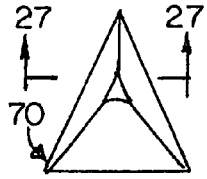
Figure 27:
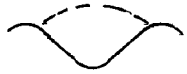
Figure 28:
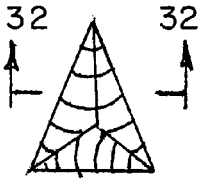
FIG. 28 is a top plan view of a tetrahedral volume formed by intersecting curved surfaces used to form a dimple geometry according to the invention.

The volume of FIG. 23 is a truncated tetrahedron 70. The top of the tetrahedron is truncated by a fourth concave surface. The cross-section of the tetrahedron 70 taken along line 27—27 produces the dimple cross-sectional configuration shown in FIG. 27.

Figure 29:
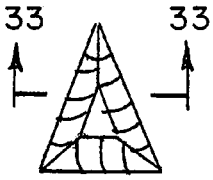
FIGS. 29–31 are top plan views of the tetrahedral volume of FIG. 28 where the top portion of the volume has been truncated in accordance with the invention.
Figure 30:
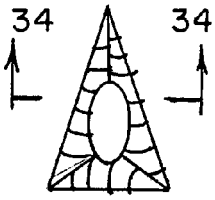
Figure 31:
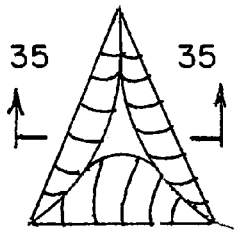
Figure 32:
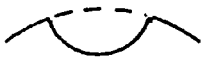
FIGS. 32–35 are sectional views taken along lines 32—32, 33—33, 34—34 and 35—35 of FIGS. 28–31, respectively, showing the resulting cross-sectional dimple configurations thereof.
Figure 33:
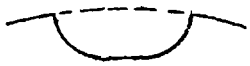
Figure 34:
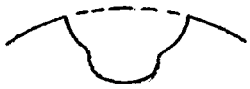
Figure 35:
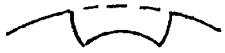

FIGS. 28–31 are similar to FIGS. 20–23 except that the tetrahedral volumes are defined by curved rather than planar surfaces. The curves may be portions of a sphere or cylinder or other curved geometric shape. The truncations in FIGS. 29–31 are formed by planar, concave, and convex surfaces, respectively, in the same manner as the truncations in FIGS. 21–23. The dimple configurations resulting from cross-sections taken along lines 32—32, 33—33, 34—34, and 35—35 are shown in FIGS. 32, 33, 34, and 35, respectively.

Figure 36:
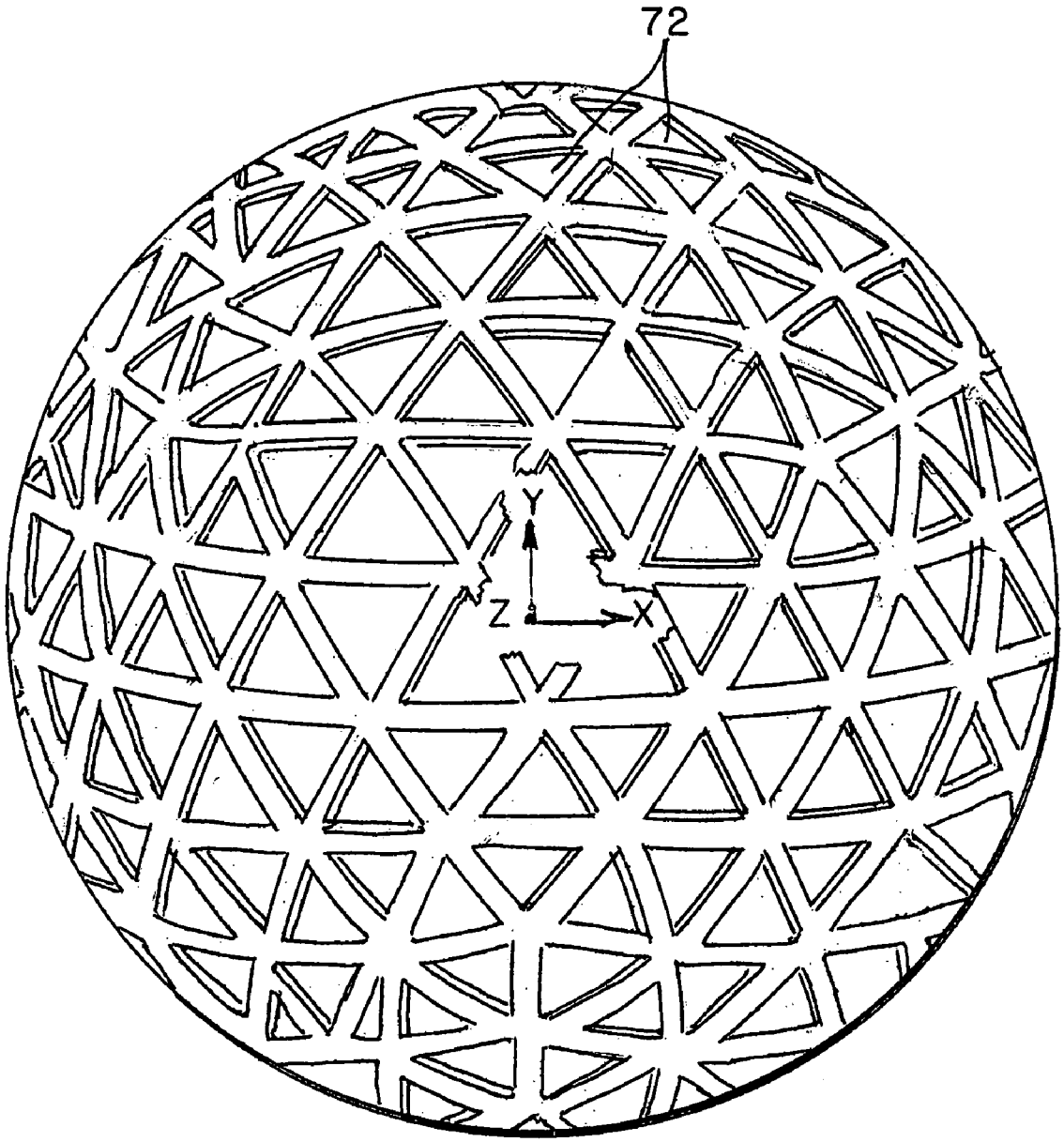
FIG. 36 is a plan view of a golf ball having dimples formed using a truncated tetrehedral volume geometry.

In FIG. 36 is shown a golf ball containing triangular dimples 72 with planar sides. The bottom surfaces of the dimples are formed by a sphere concentric with the golf ball surface but having a slightly smaller diameter than the golf ball. Where the edges of the dimples meet, small fillet radii are provided to round off the transition between adjacent dimples. Such a dimple pattern provides 93.86% coverage of the golf ball surface where the dimple depth is 0.006 inches, the ball radius is 1.693 inches, the edge angle is 15.25°, and the total volume ratio is 1.45%.

While the preferred forms and embodiments of the invention have been illustrated and described, it will be apparent to those of ordinary skill in the art that various changes and modification may be made without deviating from the inventive concepts set forth above.

What is claimed is:

1. A non-circular dimple for a golf ball, comprising:

a bottom surface including multiple portions defined by a plurality of intersecting cylindrical surfaces, each of the multiple portions corresponding with one of the plurality of intersecting cylindrical surfaces, wherein the bottom surface contains a first bottom portion defined by a first cylinder having a first radius, a second bottom portion defined by a second cylinder having a second radius, and a third portion defined by a third cylinder having a third radius, each of the first cylinder, second cylinder and third cylinder having parallel axes and the first radius being greater than the second radius or the third radius.

2. A non-circular dimple according to claim 1, wherein the second radius and the third radius are equal.

3. A non-circular dimple according to claim 2, wherein the second cylinder and the third cylinder have axes contained in the same plane.

4. A golf ball having an outer surface containing a plurality of dimples, at least one of said dimples comprising:

a bottom surface including multiple portions defined by a plurality of intersecting cylindrical surfaces, each of the multiple portions corresponding with one of the plurality of intersecting cylindrical surfaces, wherein the bottom surface contains a first bottom portion defined by a first cylinder having a first radius, a second bottom portion defined by a second cylinder having a second radius, and a third portion defined by a third cylinder having a third radius, each of the first cylinder, second cylinder and third cylinder having parallel axes and the first radius being greater than the second radius or the third radius.

5. A golf ball comprising:

a surface, the surface comprising a plurality of dimples consisting of twelve dual radius penta-semicylinder dimples, fifty symmetric dual radius tri-cylinder dimples and two hundred sixty non-symmetric dual radius tri-cylinder dimples;

wherein the golf ball has 90% dimple surface coverage.

6. The golf ball according to claim 5 wherein each of the fifty symmetric dual radius tri-cylinder dimples has twelve dimple surfaces.

* * * * *